US005775417A

United States Patent [19]

Council

[11] Patent Number: 5,775,417

[45] Date of Patent: Jul. 7, 1998

[54] COILED TUBING HANDLING APPARATUS

[76] Inventor: Malcolm N. Council, 332 Ridge Crest Dr., Richardson, Tex. 75080

[21] Appl. No.: 823,786

[22] Filed: Mar. 24, 1997

[51] Int. Cl.[6] ..... E21B 19/08; E21B 19/22

[52] U.S. Cl. ..... 166/77.3; 226/172

[58] Field of Search ..... 166/77.3, 85.1; 226/172; 254/29 R

[56] References Cited

U.S. PATENT DOCUMENTS

| | | | |
|---|---|---|---|
| 3,285,485 | 11/1966 | Slator | 226/172 |
| 3,559,905 | 2/1971 | Palynchuk | 242/390.5 |
| 3,669,329 | 6/1972 | Blanchet et al. | 226/108 |
| 3,945,547 | 3/1976 | Ledebur | 226/172 X |
| 4,585,061 | 4/1986 | Lynons, Jr. et al. | 166/77.3 |
| 4,655,291 | 4/1987 | Cox | 226/172 |
| 4,899,823 | 2/1990 | Cobb et al. | 166/351 |
| 5,094,340 | 3/1992 | Avakov | 198/626.1 |
| 5,553,668 | 9/1996 | Council et al. | 166/77.3 |

*Primary Examiner*—David J. Bagnell
*Attorney, Agent, or Firm*—Arthur F. Zobal

[57] ABSTRACT

The coiled tubing handling apparatus includes a base and a frame. First and second pairs of plate members are coupled to the frame. A drive sprocket and an idler sprocket are coupled to the first pair of plate members for supporting a first continuous gripper chain with gripper members for movement along a first path. A drive sprocket and an idler sprocket are coupled to the second pair of plate members for supporting a second continuous chain with gripper members for movement along a second path. A drive system is provided for moving the gripper chains together along the two paths for gripping and moving a tube. Two pairs of idler sprockets are coupled to each of the first and second pairs of plate members for supporting a linear bearing chain within each of the two gripper chains. A linear bearing race engages each linear bearing chain for causing the two linear bearing chains to engage the two gripper chains respectively for causing the two gripper chains to move linearly along the first and second paths. A unique slack adjusting means is provided for each of the linear bearing chains and a unique slack adjuster is provided for each of the gripper chains. The base includes structure which allows one pair-of plate members to be moved laterally relative to the other pair of plate members and also which allows both pairs of plate members to be moved laterally relative to the frame.

10 Claims, 8 Drawing Sheets

COILED TUBING HANDLING APPARATUS

BACKGROUND OF THE INVENTION

1. Field of the Invention

The present invention relates to an apparatus for inserting and removing a continuous length of tubing into and from an oil or gas well. With minor modifications the assembly is also readily usable as a pipe tension machine for installing oil or gas flow lines connecting various petroleum facilities.

2. Description of the Prior Art

For over twenty-five years, the coiled tubing service unit, of which the injector apparatus is the most vital part, has been an accepted means of servicing wells that produce oil or gas. Progress was slow initially due to a lack of reliability in the tubing itself. Improvements in metallurgy and manufacturing technology have resulted in increased material strength and more consistent material quality. Coiled tubing is now manufactured from strips of low-alloy mild steel which are precision cut, rolled and seam welded in a range of sizes up to 3½" outside diameter. The larger of these sizes 2⅜", 2⅞" and 3½" are also the outside diameters of 2", 2½" and 3" pipe. At this point the distinction between coiled tubing and coiled pipe becomes moot.

Concurrent with manufacturing technology and metallurgy improvements appeared a great increase in the reliability of the coiled tubing string. Increased resistance to hydrogen disulfide induced embrittlement and stress corrosion cracking have made operations in sour environments relatively safe.

The increased range of tubing diameters and wall thickness and the on going development of higher strength alloys are allowing the industry to increase flow rates, operating depths and pressure limits to new levels in coiled tubing operations.

Coiled tubing applications can currently address a wide range of customer requirements. New techniques are continually being developed or investigated such as drilling horizontally with a steerable, fluid powered drilling motor at the end of the coiled tubing string.

Both on land and offshore, the coiled tubing unit is becoming a universal well servicing method or means. Present capabilities, current applications and imminent developments are classified into the five categories shown below:

a. Hydraulic applications involve circulation of fluids (single or two phase gas/liquid mixtures) through coiled tubing, with some operations requiring annular returns. Hydraulic injection of certain types of fluids for stimulation of the production of hydrocarbon deposits, displacing fluids in the well, and performing cleaning operations on the well production tubing were the original and remain the most frequently used coiled tubing well services preformed worldwide.

b. Electrical applications are those that employ downhole tools which are powered by and transmit through an electrical cable which is resident in the coiled tubing.

c. Mechanical applications involve the downhole conveyance of required tools; some of which may be operated by force manipulation from the surface.

d. Permanent applications encompass all operations where coiled tubing is permanently installed in a well or used as flowline.

e. Hybrid applications are those which combine the benefits of one or more of the above categories. These categories can be performed simultaneously or sequentially, often in a single run.

In view of the increased reliability and size range of coiled tubing and the expanding range of its applications and development goals, there is a need for an injector design with increased adaptability to overcome design short comings associated with present injector apparatus.

The greater number of coiled tubing injector designs follow the essentials laid out by Slator in U.S. Pat. No. 3,285,485 differing only in how the tubing gripper assemblies apply the gripping force to the tubing or pipe. Most designers favor direct acting hydraulic cylinders acting in the extend or retract mode to apply force more directly to the gripper blocks instead of the cylinder and linkage methods favored by the Slator patent. Lyons, Jr. et al. in U.S. Pat. No. 4,585,061 favor cam rollers mounted to the backside of the gripper blocks. A skate member upon which the cam rollers move, is then pressed, by hydraulic cylinders, against a similar but stationary skate.

Lyons, Jr. et al. in their patent and others employ meshing gears on both injector drive sprockets for the expressed purposed of synchronization of these sprockets to maintain the same hoisting and pulldown loads. With regard to this belief, one is reminded that the coefficient of fiction of steel upon steel is about 0.5, so at any load less than the maximum rating of the injector, the correctly designed steel, gripper block will not slip on the tubing if the gripping force applied to the tubing by the gripping mechanism is, at least, twice the load being lifted. The tubing is in fact, a synchronizing medium between the two traction drives. Slight differences in the efficiencies or torque capabilities of these two drives is of no consequence. The sum of their two outputs will equal the load being lifted. Thus synchronizing gears are unnecessary.

When examining the design of pipe tensioners such as those shown in U.S. Pat. No. 3,669,329 a kinship to coiled tubing injectors is apparent. One immediately notices the absence of timing gears which means that the distance between both drives need not be fixed inside a single support frame as with conventional coiled tubing injectors. By mounting both tensioner halves on end and supplying a cylinder means to establish a gripping force, a rudimentary injector is established. Having load cells beneath the traction assemblies which are slidably connected to a stationary base will establish a means of measuring total lift.

Pipemaster Pipe Tensioners, as the above devices are known are available as single units or as multiple units for tandem mounting, one behind the other, in order to obtain higher tensions when required. In light of this, coiled tubing injectors can also be mounted in tandem vertically for increased lift capacity.

Pipe tensioners such as Pipemaster are designed to handle the largest diameter pipe which may have brittle protective coatings. The gripper pads have elastomer surfaces to protect the pipe coatings while many of the traction drive components are adapted from crawler tracked vehicles such as those manufactured by Caterpillar. Pipe tensioners for laying flowlines are essentially handling coiled tubing made to pipe O.D. dimensions and can be handled using traction drives composed largely of roller chain components as do coiled tubing injectors, beginning with Slator's design.

The use of large diameter coiled tubing as flowlines is somewhat limited due to the inability of many coiled tubing injectors to handle large O.D. tubing and the difficulty of easily mounting and controlling the injector in a near horizontal position. Recent attempts to market a single purpose flow line pipe tensioner machine have failed due to the inability of users to justify the cost of this special apparatus.

The heart of a coiled tubing injector is the means by which force can be evenly applied to a certain number of gripper blocks. The required total force applied will normally equal twice the load being lifted. Various schemes are in use involving both fixed cam rollers and gripper blocks mounted cam rollers. Basically, there must be enough cam rollers or roller bearings in contact with the gripper chain to transfer this force without premature bearing failure. The most successful method was proposed by Palychuk in U.S. Pat. No. 3,559,905. As this design has evolved it has become very expensive to produce and difficult to assemble or maintain.

SUMMARY OF THE INVENTION

It is an object of the invention to provide a coiled tubing handling apparatus which is easy to assemble and disassemble and operate and which has advantages lacking in other related devices.

The coiled tubing handling apparatus comprises a base and a frame. First and second pairs of plate members are coupled to the frame. A drive sprocket and an idler sprocket are coupled to the first pair of plate members for supporting a first continuous gripper chain with gripper members for movement along a first path. A drive sprocket and an idler sprocket are coupled to the second pair of plate members for supporting a second continuous chain with gripper members for movement along a second path. Means is provided for moving the gripper chains together along the two paths for gripping and moving a tube. Two pairs of idler sprockets are coupled to each of the first and second pairs of plate members for supporting a linear bearing chain within each of the two gripper chains. A linear bearing race engages each linear bearing chain for causing the two linear bearing chains to engage the two gripper chains respectively for causing the two gripper chains to move linearly along the first and second paths.

In another aspect a unique slack adjusting means is provided for each of the linear bearing chains.

In a further aspect a unique slack adjuster is provided for each gripper chain.

The base includes structure which allows one pair of plate members to be moved laterally relative to the other pair of plate members and also which allows both pairs of plate members to be moved laterally relative to the frame.

In a further embodiment, the frame allows easy assembly and removal of the traction drives.

In addition the apparatus of the invention may be modified to allow it to be used as a pipe tension machine.

DESCRIPTION OF THE PREFERRED EMBODIMENT

Figure 7:
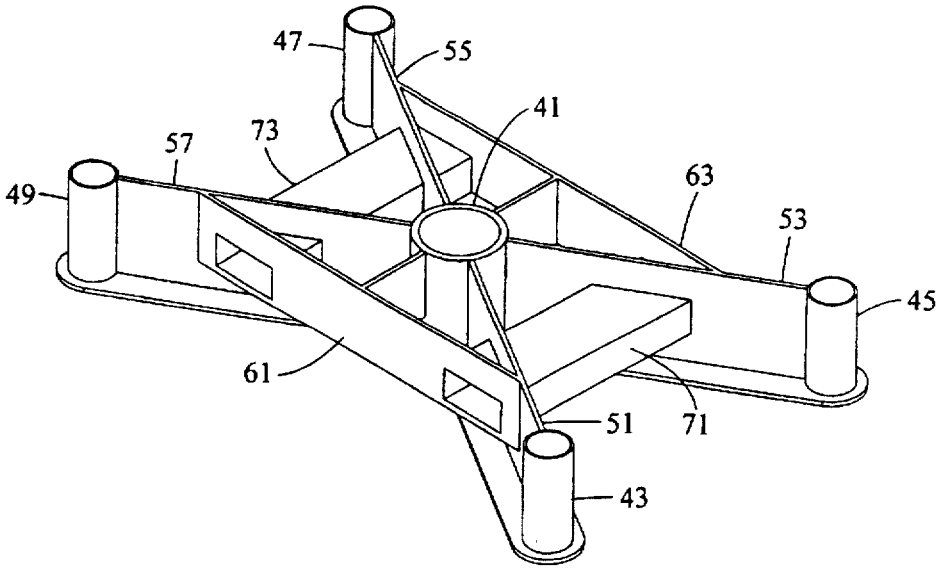
FIG. 7 is an isometric view of the main base member of the apparatus.

Referring now to the drawings, the apparatus of the invention is identified by reference numeral 21. It comprises a base member 23 and 25 and four tubular frame members 31, 33, 35 and 37 which extend upward. Referring to FIG. 7, the base member 23 comprises a hollow central tube 41 and four outer tubes 43, 45, 47, and 49 connected to the central tube 41 by way of plates 51, 53, 55, and 57. Plates 61 and 63 are connected to plates 51 and 57 and 53 and 55 and support two hollow rectangular tubes 71 and 73 employed for lifting purposes.

Figure 8:
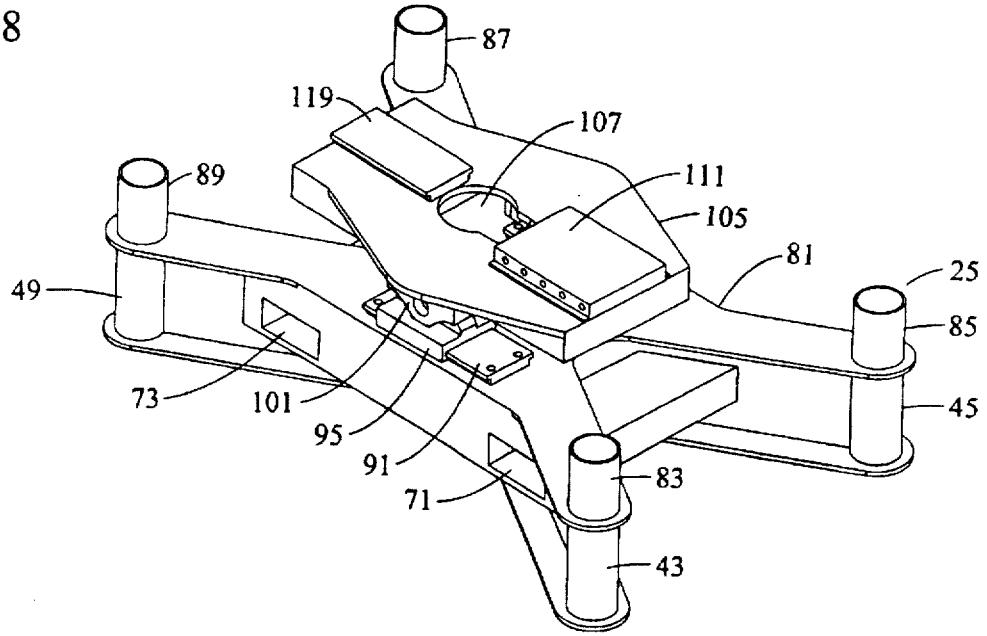
FIG. 8 is an isometric view of the base member of FIG. 7 with slidable support structure coupled thereto.

Referring to FIG. 8, the base 25 comprises a platform 81 to which four tubular members 83, 85, 87 and 89 are connected and which are aligned with tubular members 43, 45, 47, and 49 respectively. The platform 81 has apertures aligned with tubes 83, 85, 87, and 89 such that 43, 83; 45, 85; 47, 87; and 49, 89 form four hollow cylinders for receiving the tubular frame members 31, 33, 35, and 37 respectively. The center of the platform 81 has an apertures (not shown) aligned with aperture 41.

Figure 14:
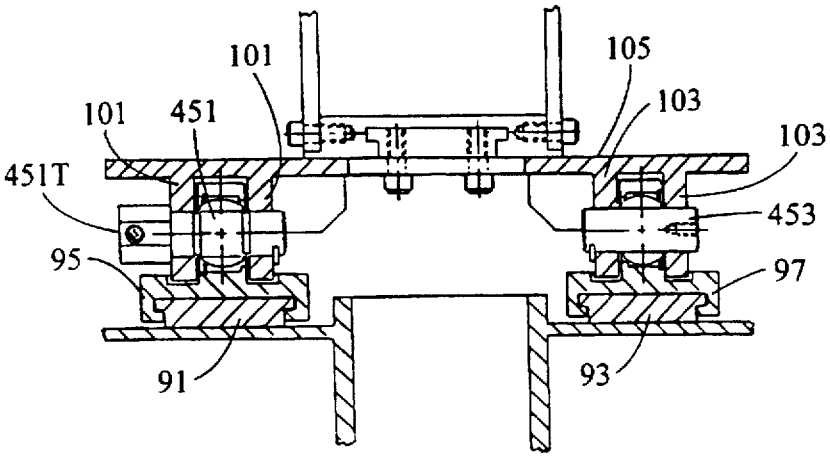
FIG. 14 is a cross-section through the load pins and the base.

Attached to the platform 81 are two parallel rails 91 and 93 (see also FIGS. 4 and 14) which slidably support two parallel slider blocks 95 and 97. Two parallel base members 101 and 103 are coupled to the blocks 95 and 97 by way of load pins 451 and 453 respectively such that the load pins 451 and 453 bear the weight of the assembly located above the load pins. A platform 105 is attached to the base members 101 and 103. The platform 105 has a central aperture 107 in alignment with the aperture of tubular member 41.

Attached to the platform 105 on one side of the apertures 107 is a block 111 to which the lower ends of two parallel side plates 113 and 115 are attached by bolts 117. A rail 119 is attached to the platform 104 on the other side of the apertures 107. Two parallel side plates 123 and 125 are attached by bolts to block 1 19A which is slidably coupled to the rail 119.

The frame members 31 and 37 have an oblique cross bar 131 connected thereto and two spaced apart cross bars 133 and 135 connected thereto at their upper ends. The frame members 33 and 35 have an oblique cross bar 141 connected thereto and two spaced apart cross bars 143 and 145 connected thereto at their upper ends.

End cross bar 151 and 153 are connected to the lower and upper ends of the frame members 31 and 33. End cross bars 161 and 163 are connected to the lower and upper ends of the frame members 35 and 37.

Figure 6:
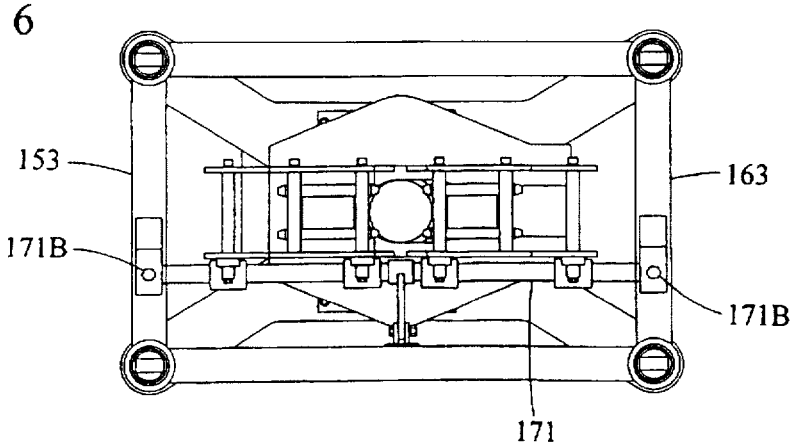
FIG. 6 is a top plan view of FIG. 1.

A cylindrical rod 171 is pivotally connected to the cross bar 145 by an arm 179. The two ends of the rod 171 have apertures formed therethrough for receiving bolts 171 B for attaching the ends to the cross members 153 and 163 as shown in FIG. 6. The bolts allow the arm 171 to be moved vertically a certain amount but prevent the arm 171 from moving laterally or sideways. The plate 115 has its upper end slidably connected to the rod 171 by block sleeve bearings 175 and the plate 125 has its upper end slidably connected to rod 171 by block sleeve bearings 177.

Plates 113 and 115 are coupled together by bolts 181 and plates 123 and 125 are coupled together by bolts 183. Upper and lower turn buckles 191 and 193 are coupled to plate 113 and to frame member 31 and upper and lower turn buckles 195 and 197 are coupled to plate 115 and frame member 33.

Thus plates 123 and 125 can be adjusted and moved laterally relative to plates 113 and 115 by movement on rails 119 and on rod 171. Adjustment is by way of hydraulic cylinders 221 coupled to plates 113 and 123 and hydraulic cylinders 223 coupled to plates 115 and 125. By adjusting the turnbuckles 191, 193 and 195, 197, both pairs of plates 113, 115 and 123, 125 can be adjusted together laterally on rail 91 relative to frame members 31, 33 and 35, 37. Each cylinder 221 and 223 is double acting. (The rod will extend or retract when pressure is applied to the proper side of the piston inside the cylinder).

Figure 12:
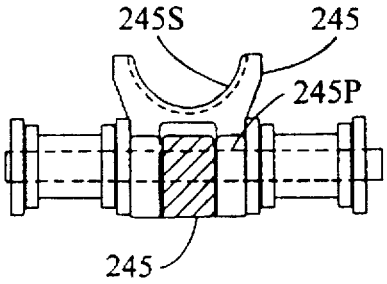
FIG. 12 illustrates one of the gripper members of the two continuous gripper chains.

Coupled between the plates 113 and 115 are a drive sprocket 231 and an idler sprocket 233. Member 235 is a drive shaft and member 237 is a sprocket hub. Member 239 is a shaft. Both sprockets 231 and 233 rotate around their axes fixed in place relative to the plates 113 and 115. Supported for rotation around the sprockets 231 and 233 is a continuous gripper chain 241 comprising chain links 243 pivotally coupled together by chain pins 245P. Tube gripper members 245 are pivotally coupled together between the chain links. Each gripper member 245 has a yoke at one end and a tongue at the other end. Adjacent gripper members 245 are pivotally coupled together in a tongue and yoke arrangement by a chain pin 245P which has its opposite ends coupled to two chain links as shown in FIG. 12. As shown, each gripper member 245 has a substantially half cylindrical concave surface 245S for gripping one side of a tube. The concave surfaces of the gripper members face outward.

Figure 13:
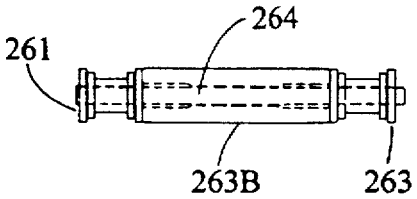
FIG. 13 is a linear bearing chain member.

Also coupled between the plates 113 and 115 are two idler sprockets 251 and 253 which are adapted to rotate about shafts 255 and 257 having axes fixed in place relative to the plates 113 and 115. Supported for rotation about the sprockets 251 and 253 is a continuous linear bearing roller chain 261 comprising chain links 263 and linear bearing rollers 263B pivotally coupled together by chain pins 264, as shown also in FIG. 13. A roller 263B is rotatably mounted on each chain pin 264. The opposite ends of each chain pin 264 are coupled to two chain links.

Connected between the plates 113 and 115 is a linear bearing mounting frame 271 comprising a pressure beam member 273 and webs 275. Coupled to the inside of beam member 273 is a linear bearing race 277 which is a straight member and bears against the inside of the gripper chain 241 and forces the chain to travel in a linear or straight path as it travels along the race 277.

Figure 9:
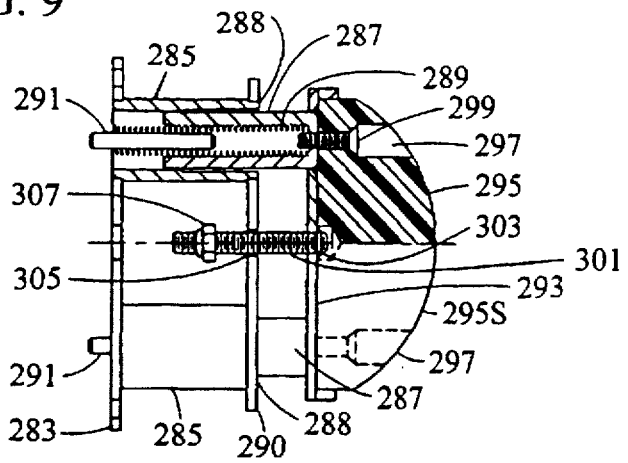
FIG. 9 illustrates one of the slack adjustor for the linear bearing chains.

Referring also to FIG. 9 a slack adjuster 281 is provided for adjusting the slack of the linear bearing chain 261. The slack adjuster 281 comprises a base 283 secured to the frame 237 with two hollow cylinders 285 secured thereto into which are slidably located two hollow cylinders 287. One end of a spring 289 is located in each cylinder 287 therein and with the other end of the spring fitted around a rod 291 which is connected to the frame 273. The cylinders 287 move freely through apertures 288 formed through plate 290 attached to the open ends of cylinders 285. Connected to the cylinders 287 is a plate 293 which supports a plastic member 295 which has a rounded surface 295S for engaging the inside of the bearing chain 261 and linear bearing rollers 263B. The springs 289 urge the member 295 and hence the chain 261 away from the frame 273 to take up the slack of the chain 261 as it wears and to maintain the chain tight. The member 295 has two apertures 297 for receiving bolts 299 around which the outer ends of the springs 289 fit. The member 295 preferably is made of ultra-high molecular weight polyethylene or similar material.

A threaded shaft 301 screwed into threaded hole 303 in plate 293 and freely movable through aperture 305 has a lock nut 307 screwed thereto which is used for determining linear bearing chain wear.

Coupled between the plates 123 and 125 are drive a sprocket 23 1A and an idler sprocket 233A. Member 235A is a drive shaft and member 237A is a sprocket hub. Member 239A is a shaft. Both sprockets 231A and 233A rotate around their axes fixed in place relative to the plates 123 and 125. Supported for rotation around the sprockets 23 1A and 233A is a continuous gripper chain 241A comprising chain links 243A pivotally coupled together by chain pins 245P. Tube gripper members 245A are provided which are the same as members 245 as previously described and shown in FIG. 12. Adjacent gripper members 245A are pivotally coupled together in a tongue and yoke arrangement by a chain pin 245P which has its opposite ends coupled to two chain links as previously described with respect to gripper members 245. Each gripper member has a substantially half cylindrical concave surface 245S for gripping one side of a tube. The concave surfaces of the gripper members face outward.

Also coupled between the plates 123 and 125 are two idler sprockets 251A and 253A which are adapted to rotate about shafts 255A and 257A having axes fixed in place relative to the plates 123 and 125. Supported for rotation about the sprockets 251A and 253A is a continuous linear bearing roller chain 261A comprising chain links 263A and linear bearing rollers 263B pivotally coupled together by chain pins 264. Each of the linear bearing rollers 263B is the same as the roller shown in FIG. 13. A roller 264B is rotatably mounted on each chain pin 264. The opposite ends of each chain pin are coupled to two chain links.

Connected between the plates 123 and 125 is a linear bearing mounting frame 271A comprising a pressure beam member 273A with webs 275A. Coupled to the inside of beam member 273A is a linear bearing race 277A which is a straight member and bears against the inside of the gripper chain 241 A and forces the chain to travel in a linear or straight path as it travels along the race 277A.

A slack adjuster 281A which is the same as that shown at 281 in FIG. 9 is provided for adjusting the slack of the linear bearing chain 261A.

Figure 1:
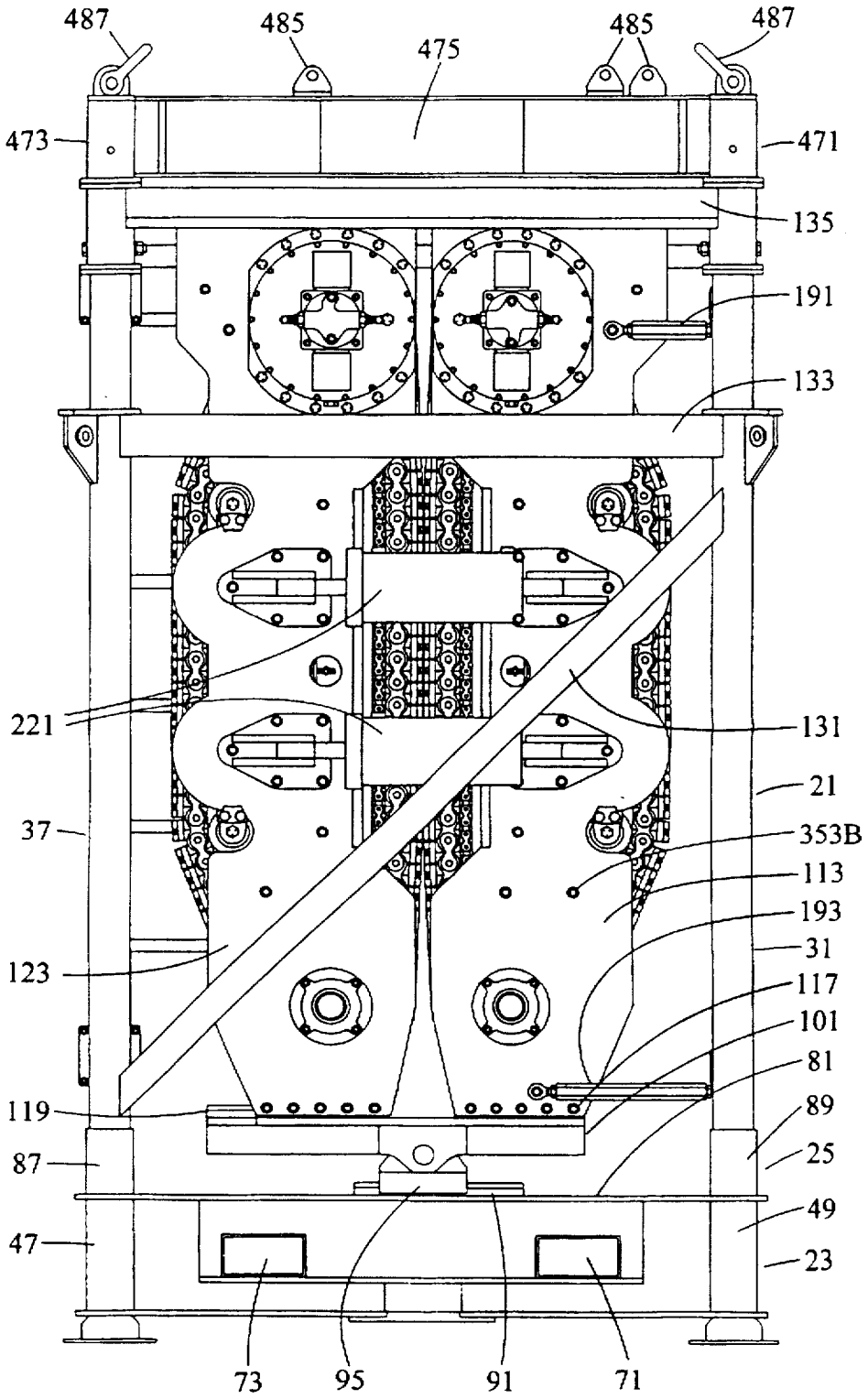
FIG. 1 illustrates one side of the apparatus of the invention.
Figure 2:
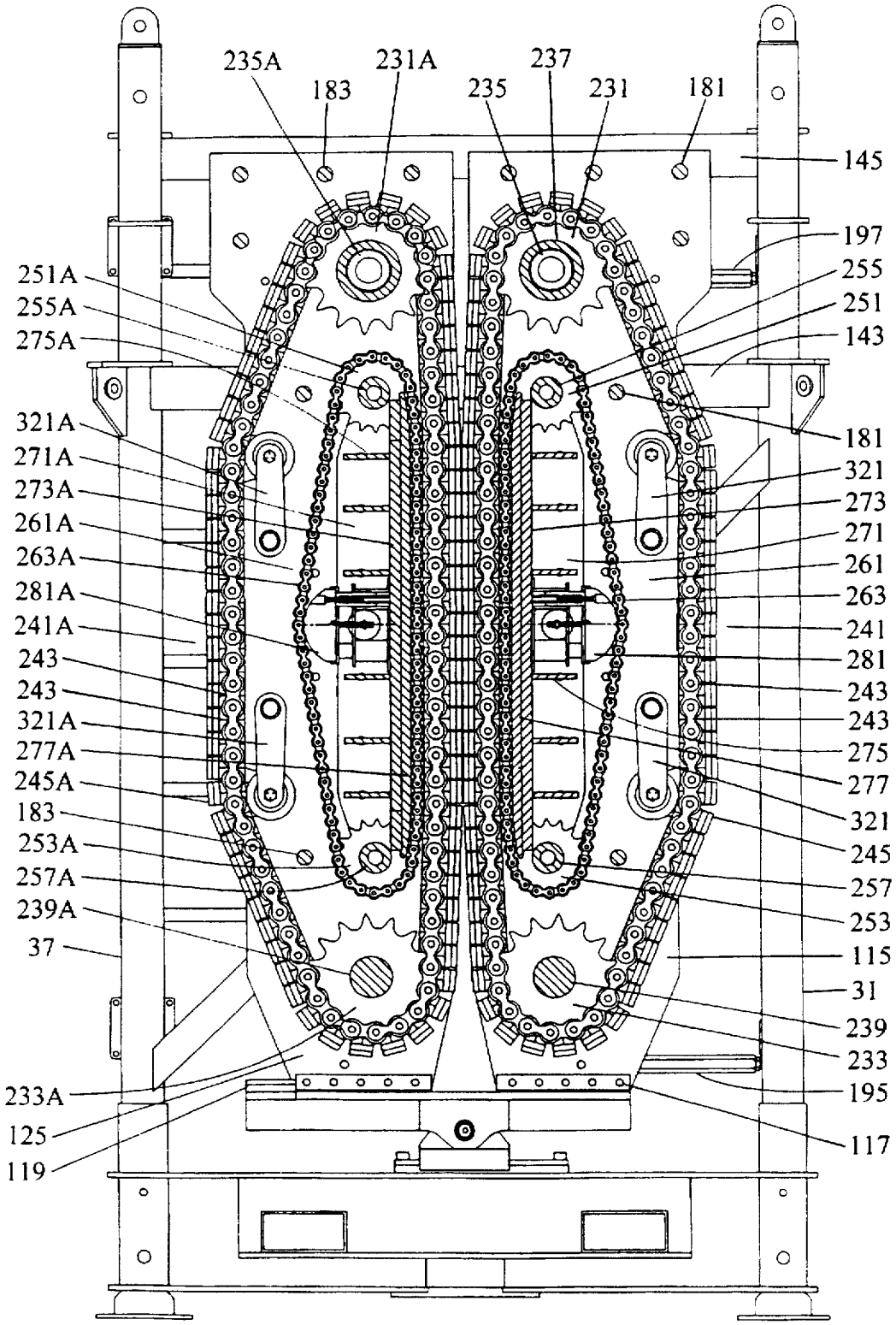
FIG. 2 illustrates the same side of the apparatus of FIG. 1 with the two side plates of FIG. 1 removed.
Figure 10:
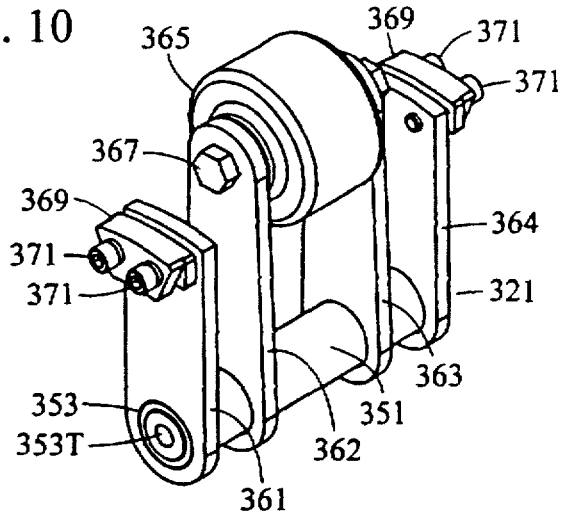
FIG. 10 is an isometric view of one of the slack adjusters for one of the gripper chains.
Figure 11:
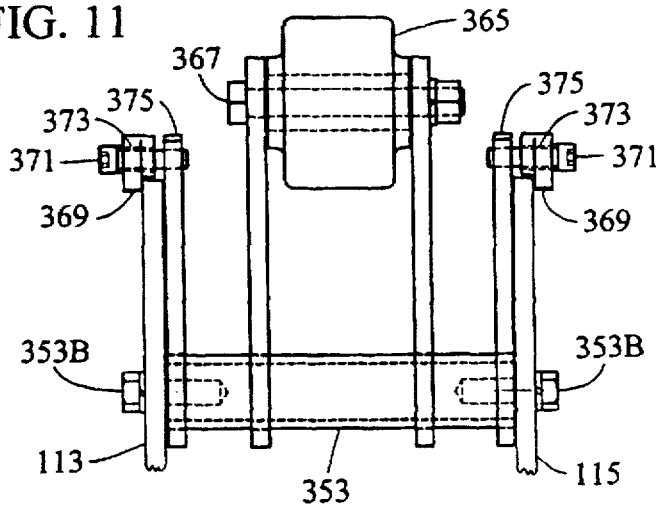
FIG. 11 is an end view of the slack adjuster of FIG. 10.

Referring to FIGS. 2 and 10, two pairs of slack adjusters 321 and 321A are provided for adjusting the slack of each of the gripper chains 241 and 241A. Slack adjusters 321 are coupled to plates 113 and 115 and slack adjusters 321A are coupled to plates 123 and 125. Since each of the slack adjusters is the same, only the upper slack adjust 321 coupled to the plates 113 and 115 will be described. It comprises a hollow tube 351 having a shaft 353 extending therethrough around which the tube 351 can rotate. The shaft 353 has a threaded aperture 353T formed in each end. The tube 351 extends through apertures formed through four arm 361, 362, 363, and 364 being fixedly connected to the tube 351. The arms 362 and 363 support a roller 365 which rotates on a shaft of a bolt 367 coupled between arms 362 and 363. The roller 365 is formed of ultra high molecular weight polyethylene or similar material. Two L-shaped clamps 369 are coupled to the arms 361 and 364 by bolts 371 having threaded shafts which extend through apertures 373 formed through the clamps 115 and are screwed into apertures 375 formed through arms 361 and 364 to clamp the member 321 to the plates 113 and 115 such that the roller 365 engages the inside of the chain 241 as shown in FIGS. 1 and 2. The shaft 353 is coupled to the plates 113 and 115 by two bolts 353B which extend through apertures formed through the plates and which are screwed into the apertures 353T at each end of the shaft such that the clamp 321 may pivot about the shaft. In order to take up the slack of the chain 241 as it wears, the bolts 371 are loosened and the arms 352 and 363 and hence the roller 365 are rotated outward and clamped in the new position by tightening the bolts 371 of the clamps 369 against the plates 113 and 115.

Figure 4:
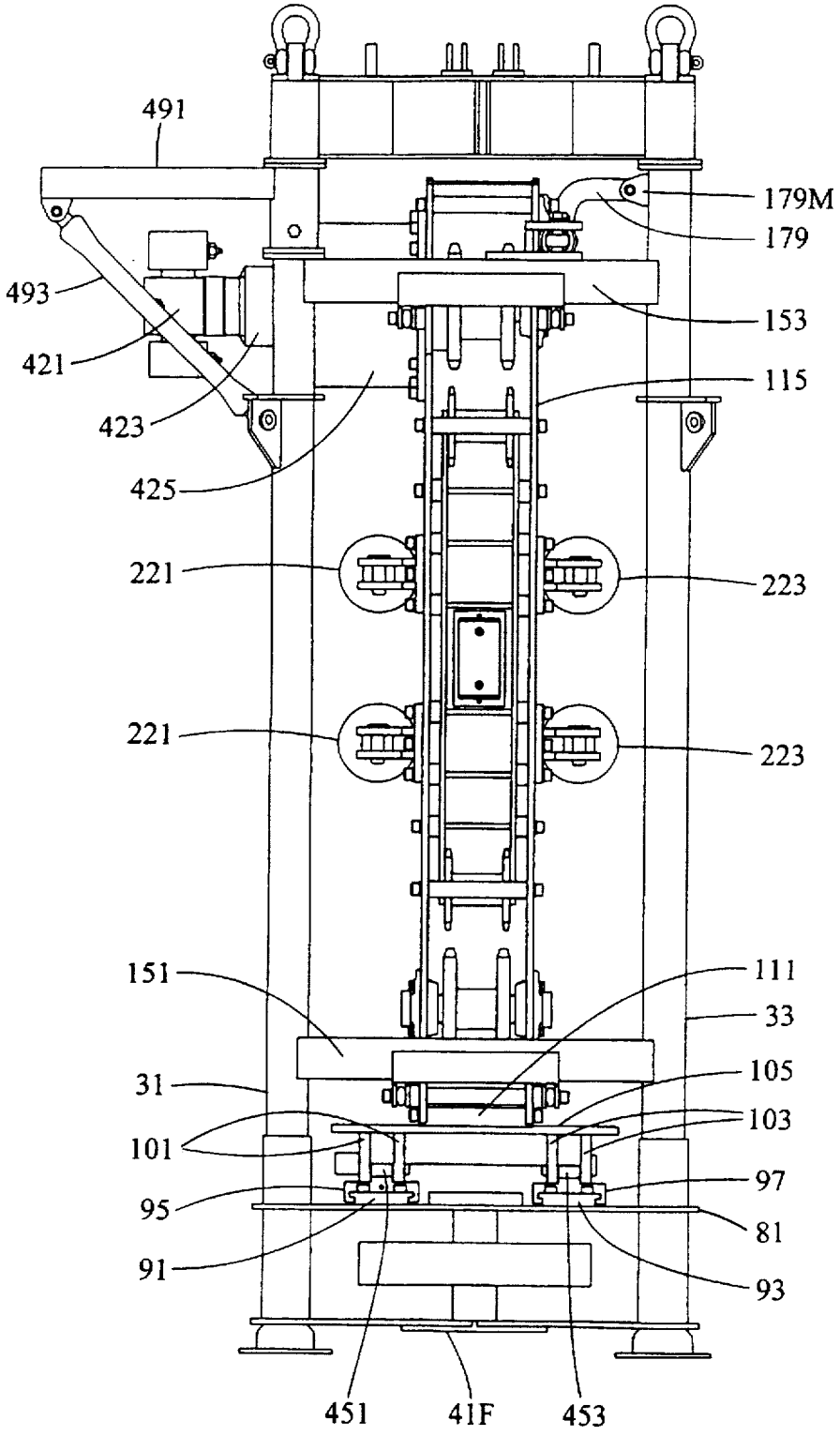
FIG. 4 illustrates one end of the apparatus as seen form the right of FIG. 1.
Figure 5:
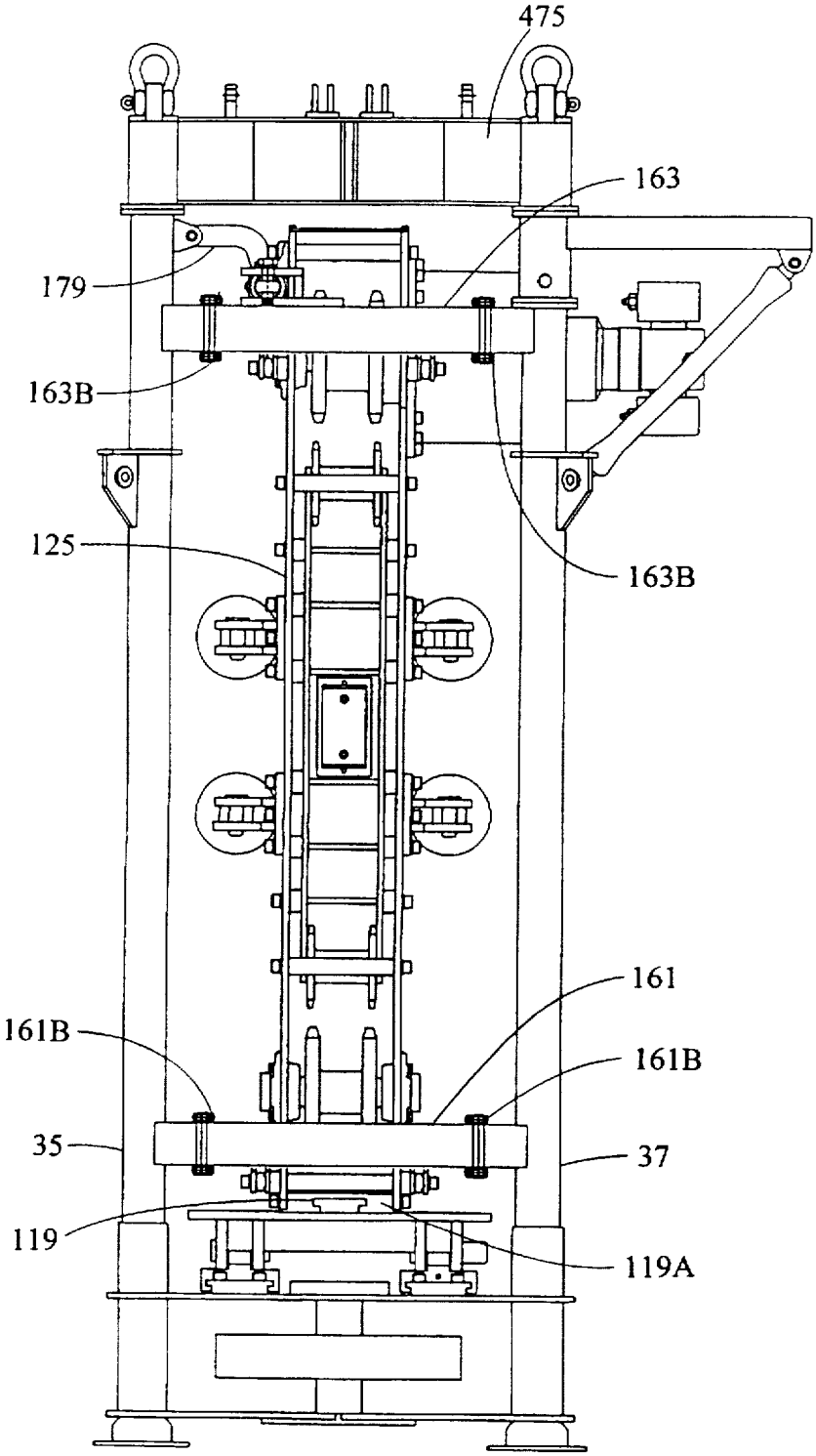
FIG. 5 illustrates the other end of the apparatus as seen from the left of FIG. 1.

Referring to FIG. 4, a hydraulic motor 421 with a brake 423 and planetary reducers 425 are provided for rotating the sprockets 231 and 231A and hence the gripper chains 241 and 241A either clockwise as seen in FIG. 2 to cause the gripper member 245 to grip both sides of the tubing and move the tube downward through the opening 41 into the borehole formed in the earth or counter clockwise as seen in FIG. 2 to move the tubing upward from the borehole. In order to adjust the system to grip different size tubing the turnbuckles 191, 193, 195, 197 can be adjusted to move both pairs of plates 113, 115 and 123, 125 and hence both gripper chains laterally together relative to the frame and/or the hydraulic cylinders 221 and 223 can be actuated to move the plates 123 and 125 and hence the gripper chain 241 A laterally relative to the plates 113 and 115 and hence the gripper chain 241.

The invention disclosed herein is fabricated from mild steel. The resulting weldment requires a minimum of machine work afterward. The linear bearing races 277, 277A are machined from tool steel which is then through hardened before being bolted into place. Previous designs included alloy steel weldments that were extensively machined before the entire assembly was case hardened to achieve the hardened linear bearing race which was the prone to wearing through the thin hardened case.

The invention disclosed herein includes two fixed position idler sprockets 251, 253 and 251A, and 253A producing precise parallel movement of the linear bearing chains 261 and 261A in both upward and downward movement as the gripping force is transferred by the linear bearing races to the back of the gripper blocks. Previous designs using a single fixed idler sprocket and an adjustable or spring loaded sprocket to control chain slack are more expensive to produce and may allow the bearing chain to skew sidewise in its movement subjecting it to breakage, if not closely maintained. In addition, the idler sprockets of the invention feature inexpensive solid bearings which may be lubricated through openings in the traction drive side plates.

Linear bearing chain slack in the system of the invention is controlled by the unique slack adjuster 281 located on the back side of the linear bearing mounting frame approximately midway between the two fixed sprockets. the slack adjuster features a large radius ultra high molecular weight polyethylene or similar material block mounted on a flat plate which is supported by two telescoping spring loaded posts. Spring tension to control chain slack is then applied to the large arc as the chain rollers pass across it, producing a uniform tension without oscillatory movement of the chain or tensioning device. Before assembly or chain removal, the tension springs may be compressed producing slack in the linear bearing chain by taking up on the threaded shaft 301 extending from the back of the arc mounting plate. The locknut 307 is accessible through openings in either side of the traction drive side plates. The position of the locknut is to be used as a indicator of linear bearing chain wear as well as wear of the plastic arc.

Each of the two required traction drive assemblies is formed by enclosing the linear bearing assembly between a pair of sideplates 113, 115 and 123, 125 which hold in correct alignment the components of the traction drive. Included are the gripper chain drive sprocket and drive assembly, a gripper chain idler sprocket, two gripper chain slack adjusting mechanisms and various posts bolted between the sideplates to control spreading or flexing.

Due to the absence of synchronizing gears on the drive sprocket shafts, the traction drive assemblies can be quite narrow from sideplate to sideplate allowing the use of shorter, smaller diameter drive shafts, idler shafts, and associated parts, contributing to a lighter more rigid assembly. Assembly is easily accomplished with one side plate removed.

The sideplates are identical in profile except for the larger diameter bores and bolt patterns in the plates 113, 123 required to mount the planetary gear drives. When cut with plasma-arc or similar equipment, very little additional machining is required for precision bores, drilled holes and the truing of weight bearing edges. No welding of load bearing bosses straightening from warpage or additional machining is necessary allowing an assembly which is easily manufactured.

The idler sprockets of the disclosed traction drive assembly is fixed in position in a simple flange bearing mountings. This arrangement holds the sprockets in exact alignment and relationship with the linear bearing assembly. This is especially important when the injector is required to push the tubing through the stripper against well pressures which may amount to 5000 psi or more.

Other prior art designs may remove wear generated slack from the gripper chain at the idler sprocket. The prior art idler sprocket may be mounted in a pivoting housing which is spring loaded or receives resistive force from a hydraulic cylinder. Another version employs two sliding bearing mounts which are spring loaded or adjusted with set-screws. Both versions are difficult to keep in alignment and add additional length to the overall height of the assembly as well as the expense and complication of its manufacture. Springs may fatigue and break due to the cyclic motion imparted to the idler sprocket by the gripper chain assembly.

The gripper chain slack removal means preferred for this invention comprises of two ultra high molecular weight polyethylene or similar material rollers for each gripper chain mounted on pivoting arms on the back or outside of each traction drive assembly. Both rollers run on the smooth underside of the gripper blocks without the cyclic movement characteristic of sprocket slack adjusters. No additional tension is added to the gripper chain as spring loaded or hydraulic tensioners are prone to do, nor do they collapse when overloaded by gripper chain tension if not correctly adjusted.

When chain wear has created noticeable slack in the gripper chains, each roller and arm assembly is manually rotated equally outward and reclampled to both sideplates. In this design the amount of rotary movement of the slack adjustment mechanism is indicative of chain wear and can be used to measure total chain wear. Chain slack or elongation is produced by wear of the roller chain bushings and pins. By using roller chain manufacture's data the radius of each slack adjuster has been calculated so that a 45° movement of both slack adjuster from the new chain or zero wear position represents 75% of the gripper chain life. 90° movement represents 98% of chain life. The chain must be replaced before the slack adjusting arms reach this point or risk breakage failure of the chain when under extreme load.

The importance of the custom designed planetary reducer gearbox by Lantec Industries, Inc. of Langley, British Colombia cannot be ignored since it contributes greatly to the performance, reliability and simplicity of design of the traction drive assemblies. Using known efficiencies, the reduction ratio can be matched by the gear box manufacturer to the required drive sprocket output and the hydraulic motor torque at near maximum output pressures of the hydraulic drive pumps. Thus, maximum rate lift will occur at or near rated performance of all components involved. The planetary custom design has been optimized to meet the performance, reliability and life requirements of coiled tubing operations without the compromises necessary when using off-the-shelf planetary units. Planetary mounting is simplified when the mounting face of the planetary is made to machinery manufacturers requirements and will not require additional mounting rings or adapters. In addition, the speed and precise control attainable with planetary reducer transmissions is noticeably smoother throughout the speed and operating range than are direct drive hydraulic motors. One planetary reducer is coupled to each drive sprocket.

As shown in FIG. 12, the gripper block members 245 of the gripper chains 241 and 241A are conventional contoured blocks. Since the subject invention uses conventional or contoured blocks, it imposes a uniform gripping load along the contact length to avoid crushing the tubing or overloading components of the linear bearing.

The drive base system that is ideal for use with conventional gripper blocks, offering a minimum offset moment at the working length of the gripper chains and allowing a uniform force to be applied by the linear beam as described as follows:

As seen in FIGS. 1–5, a single base weldment 101 and 103 is slidably attached in two places to the common frame mounting the injector assembly on the wellhead. The two attachment points are an equidistant on either side of the wellhead. The attachment means includes one pin type force sensor 451 and one simple or non load measuring pin 453. The pin 451 includes a strain gage and is calibrated to read twice the actual load. Electrical leads (not shown) extend from the pin 451 to the operator console. The center line of both pins approximately intersects the well centerline during operation, producing little or no offset moment so that the lateral load produced by the gripping cylinder is uniform along the working length of each linear bearing gripping mechanism. Were it not necessary to move the traction support base slightly in a lateral direction to compensate for various gripper block sizes, no offset moment would be produced so the lateral load exerted by the gripper cylinders will be uniform along the working length of each linear bearing gripping mechanism. However, any remaining moment is easily neutralized by the four turnbuckles 191, 193 and 195, and 197 connecting the traction drives to the well braced injector support frame.

To accomplish the desired arrangement, the traction drive assembly 113, 115, 241 is permanently attached to the single base assembly described above. This drive assembly is referred to as the primary traction drive. The second traction drive assembly 123, 125, 241A is slidably mounted to the primary traction drive base directly opposite the primary traction drive and is referred to as the secondary traction drive. Four hydraulic cylinders 221, 223 are mounted, two on each side of the traction drive assemblies. The cylinders are positioned horizontally with equidistant vertical spacing to exert a uniform force along the contact length of the linear bearing assembly. To maintain vertical and lateral alignment with the well centerline, the four precision turnbuckle assemblies pivotally connect the primary traction drive to cross members of the injector support frame.

The upper portion of each traction drive assembly is supported by a sturdy round rod 171 which attaches to the drive assemblies by means of pillow block sleeve bearings 175 and 177. This device both supports the upper drive assembly and guides the horizontal movement of each traction drive. The rod 171 is free to move slightly in a vertical direction at either end attachment point and is pivotally attached to the injector frame at a central point by way of the arm 179. One end of the arm 179 is connected to a sleeve 179S which surrounds the rod 179 and the other end is pivotally connected to member 179M which is fixedly connected to the frame. Thus, no restraining load is imposed on the load pin and slider base supports allowing the force sensor to operate properly.

Extending the gripping cylinders 221, 223 will retract the secondary traction drive 123, 125, 241A providing an opening wide enough to accommodate the largest tubing presently manufactured. Properly sized gripper blocks must be furnished to run each sized tubing and the primary traction drive must be properly aligned with the well centerline by using the precision turnbuckles 191, 193, 195, 197. By detaching the four turnbuckles connecting the primary traction drive to the injector support frame, additional extension of the gripping cylinders will produce a greater opening at the well centerline. Through this opening large diameter objects for various well applications may be passed without removing the injector from the well. These objects will include various well servicing and drilling tools as well as production related components.

Separate or independent traction drive bases, each resting upon a pin type force sensor or load pin require additional summing junction boxes to process the signal before transmission to a remote located electrical load indicator. In this invention, well centerline mounted pins placed equidistant on either side of the tubing load afford a more economical solution. A single load pin force transducer 451 , such as those manufactured by Strainsert of West Conshohocken, Pennsylvania, is calibrated to register twice the pin loading. The second load pin 453 upon which rests an equal load is a non-instrumented simple pin. Thus, the cost of a second force transducer is avoided as well as that of a summing junction box with additional electrical connections. The ability of the force sensor to register downward tubing loads or upward loads caused by well pressure is unaffected.

The injector support frame has many functions which will be described beginning with the frame base.

The frame base contains a centrally located flange 41F with a round tubular opening 41 through which the coiled tubing and larger objects may pass into the well bore. This flange is usually attached to a tubing stripper which will support the injector as it is mounted to the well. Below the stripper is normally a blowout preventor which supports both. Bracing legs may extend from the comer posts of the frame base to give additional stability and support.

The frame base contains two rectangular tubes 71 to give stability when the injector is handled by a fork lift truck by inserting the forks into the tubes 71. To the topside of the base are fitted two slotted bars 91 and 93 that interlock with two laterally moveable blocks 95 and 97 mounted to the traction drive base. The interlocking slots, resisting upward forces, enable the traction drives to force the tubing through the stripper assembly against seal friction and well pressures. The bars and moveable blocks also serve as load bearing surfaces supporting lifting loads. The previously mentioned pin type force sensor or load pin is mounted in the block 95.

Tubular members 43, 45, 47, 49 attached at the comers of the frame base form the principal structural members of the support frame. Cross braces 71, 73 of rectangular tubing and two diagonal braces 51, 55 and 53, 57 of steel plate give excellent structural rigidity. Inside the tubular comer members, telescoping legs 31, 33, 35, 37 with pads attached may be extended and cross pinned at various lengths to elevate the injector assembly during storage or allow the stripper assembly to remain attached during transport. When mounted to a well, the telescoping legs are usually removed in favor of longer telescoping brace legs that extend to the well pad or a suitable support frame around the well base.

The injector frame base and the tubular comer posts of the support frame are adequately designed structurally to support a second fully loaded injector of equal capacity and identical frame construction which has been erected directly above for the purpose of increasing or possibly doubling the total lift capacity. This may be accomplished by removing the tubing guide base 471 frame from the lower injector and guiding the upper injector frame over the protruding posts of the lower injector. The base frame 471 comprises four tubular corner posts 473 which fit over the tubular frame members 31, 33, 35, 37 at their upper ends and which have four cross members 475 connected between the comer posts 473. Flange faced load supporting joints are formed. Cross pins are inserted through both joint members for added integrity.

The injector assembly is usually constructed, stored, maintained, and transported without the tubing guide assembly or its mounting base on the injector. Once on location a tubing guide assembly of the type disclosed in U.S. Pat. No. 4,585,061 with tubing in place is lowered into position on the injector. The tubing guide assembly is connected to members 485. Four anchor shackles 487 pinned through the extreme ends of the frame comer posts hold the tubing guide base in position and also serve as attachment points for the wire rope sling used to lift the injector and tubing guide assembly on the well.

For the aid of well rig up and down a personnel platform 491 supported by braces 493 has been constructed above the hydraulic drive motors. This platform also serves to protect the motors should the injector assembly tip over on uneven ground. The platform assembly along with the frame cross brace 135 above the hydraulic motors and planetary gearboxes may be removed. With the platform bracing and through bolting removed, the frame cross brace may be lifted up over the comer posts and removed for maintenance or reassembly.

In addition to the above cross brace 135, the two end cross braces 161 and 163 adjacent to the secondary traction drive are also removable by first removing flange bolts 161B, 163B securing them at either end. With the three cross braces removed, the assembled traction drives complete with hydraulic motors may be installed or removed from the injector support frame by using a fork lift truck as a handling means, an operation which proves difficult with other coiled tubing injectors.

The apparatus of the invention has been constructed with features that enable it to be readily adaptable as a pipe tension machine for application in installing or removing coiled tubing used as flow lines connecting various petroleum production facilities.

Figure 3:
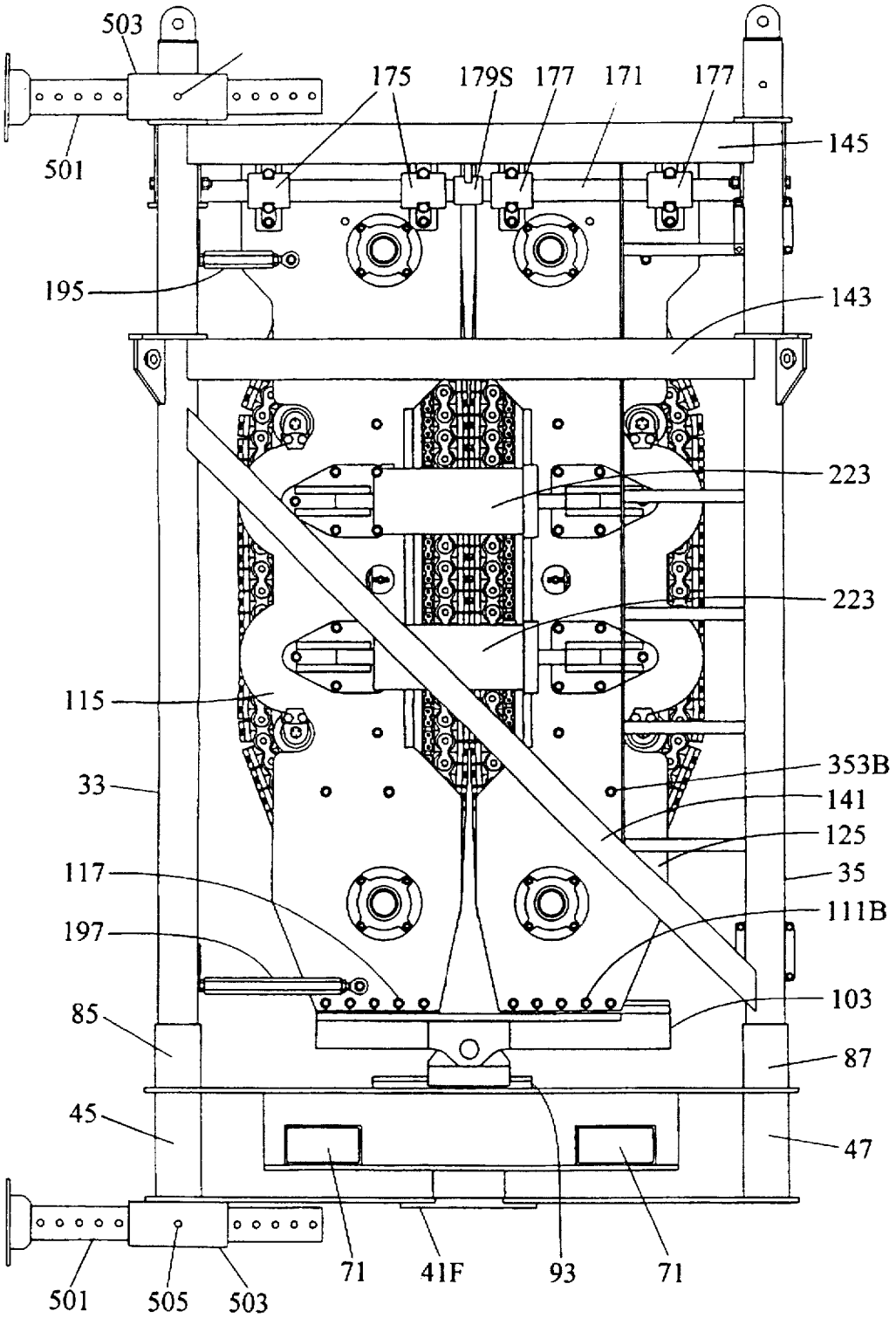
FIG. 3 illustrates the opposite side of the apparatus of FIG. 1 with modifications to allow it to be used as a pipe tension machine.

The injector mechanism is protected by sturdy rectangular frame which may be easily laid horizontally. The preferred orientation is with the secondary traction drive 123, 125, 241A upward while the primary drive remains supported by four turnbuckles. By extending the gripping cylinders the secondary drive is raised creating an opening wide enough to accept the largest coiled tubing or coiled pipe. When fitted with properly sized gripper blocks it would function more effectively than conventional injectors without compromising its use as a coiled tubing injector. Legs 501 for carrying out this function are shown in FIG. 3. The tubular frame members 31, 33 have tubular blocks 503 attached thereto to which legs 501 are attachable at different positions by pins 505.

I claim:

1. A coiled tubing handling apparatus, comprising:

a base, four spaced apart elongated frame members coupled to said base defining first and second opposite sides, a first pair of plate members coupled to said elongated frame members on said first and second opposite sides, a second pair of plate members coupled to said elongated frame members on said first and second opposite sides, a first drive sprocket coupled to said first pair of plate members, a first idler sprocket coupled to said first pair of plate members, a first continuous gripper chain, having gripper members, supported by said first drive sprocket and said first idler sprocket for movement along a first path, a second drive sprocket coupled to said second pair of plate members, a second idler sprocket coupled to said second pair of plate members, a second continuous gripper chain, having gripper members, supported by said second drive sprocket and said second idler sprocket for movement along a second path, said first and second gripper chains being supported for movement close to each other along said first and second paths for gripping a tube with their said gripper members, means for rotating said first and second drive sprockets together for moving said first and second gripper chains along said first and second paths for gripping a tube with their said gripper members and for moving the tube, a first pair of inner idler sprockets coupled to said first pair of plate members at fixed spaced apart positions surrounded by said first gripping chain, a first continuous linear bearing chain supported by said first pair of idler sprockets for rotation, a first elongated linear bearing race supported within said first linear bearing chain to cause said first linear bearing chain to engage said first gripper chain for causing said first gripper chain to move in a linear path along said first path, a second pair of inner idler sprockets coupled to said second pair of plate members at fixed spaced apart positions surrounded by said second gripper chain, a second continuous linear bearing chain supported by said second pair of idler sprockets for rotation, a second elongated linear bearing race supported within said second linear bearing chain to cause said second linear bearing chain to engage said second gripper chain for causing said second gripper chain to move in a linear path along said second path, a first slack adjusting member formed of plastic material and having an outward curved surface, and means for supporting and urging said first slack adjusting member to engage its said outward curved surface with the inside of said first linear bearing chain at a position between said first pair of inner idler sprockets, a second slack adjusting member formed of plastic material and having an outward curved surface, and means for supporting and urging said second slack adjusting member to engage its said outward curved surface with the inside of said second linear bearing chain at a position between said second pair of inner idler sprockets.

2. The coiled tubing handling apparatus of claim 1, comprising:

a slack adjuster for said first continuous gripper chain comprising:

a first main shaft pivotally coupled to said first pair of plate members, two first arm members having first ends fixedly coupled to said first main shaft and a first roller shaft coupled to second ends of said first two arm members, a first roller formed of plastic material supported to rotate around said first roller shaft, for engaging the inside said first continuous gripper chain, first clamp means coupled to said first main shaft and adjustably coupled to said first pair of plate members for allowing said first roller to be located at different positions relative to said first pair of plate members, a slack adjuster for said second continuous gripper chain comprising:

a second main shaft pivotally coupled to said second pair of plate members, two second arm members having first ends fixedly coupled to said second main shaft and a second roller shaft coupled to second ends of said two second arm members, a second roller formed of plastic material supported to rotate around said second roller shaft for engaging the inside of said second continuous gripper chain, and second clamp means coupled to said second main shaft and adjustably coupled to said second pair of plate members for allowing said second roller to be located at different positions relative to said second pair of plate members.

3. The coiled tubing handling apparatus of claims 2 comprising:

said base comprises:

two lower spaced apart rails coupled to said base such that said two lower rails are located in two generally parallel outer planes, two slide members coupled to said two lower rails respectively for movement in said two outer planes, an upper base coupled to said two slide members, said first pairs of plate members being fixedly coupled to said upper base and said second pair of plate members being slidably coupled to said upper base for movement in two inner planes generally parallel to said two outer planes, first adjusting means coupled to said plate members of said first and second pairs of plate members for moving said second pair of plate members relative to said first pair of plate members, both of said pairs of plate members being movable together by moving said two slide members on said two lower rails, second adjusting means coupled to said first pair of plate members and to two of said elongated frame members closest to said first pair of plate members for moving said first pair of plate members and hence both pairs of plate members and said two slide members on said two lower rails relative to said two elongated frame members.

4. The coiled tubing handling apparatus of claim 1, comprising:

said base comprises:

two lower spaced apart rails coupled to said base such that said two lower rails are located in two generally parallel outer planes, two slide members coupled to said two lower rails respectively for movement in said two outer planes, an upper base coupled to said two slide members, said first pairs of plate members being fixedly coupled to said upper base and said second pair of plate members being slidably coupled to said upper base for movement in two inner planes generally parallel to said two outer planes, first adjusting means coupled to said plate members of said first and second pairs of plate members for moving said second pair of plate members relative to said first pair of plate members, both of said pairs of plate members being movable together by moving said two slide members on said two lower rails, second adjusting means coupled to said first pair of plate members and to two of said elongated frame members closest to said first pair of plate members for moving said first pair of plate members and hence both pairs of plate members and said two slide members on said two lower rails relative to said two elongated frame members.

5. A coiled tubing handling apparatus, comprising:

a base, four spaced apart elongated frame members coupled to said base defining first and second opposite sides, a first pair of plate members coupled to said elongated frame members on said first and second opposite sides, a second pair of plate members coupled to said elongated frame members on said first and second opposite sides, a first drive sprocket coupled to said first pair of plate members, a first idler sprocket coupled to said first pair of plate members, a first continuous gripper chain, having gripper members, supported by said first drive sprocket and said first idler sprocket for movement along a first path, a second drive sprocket coupled to said second pair of plate members, a second idler sprocket coupled to said second pair of plate members, a second continuous gripper chain, having gripper members, supported by said second drive sprocket and said second idler sprocket for movement along a second path, said first and second gripper chains being supported for movement close to each other along said first and second paths for gripping a tube with their said gripper members, means for rotating said first and second drive sprockets together for moving said first and second gripper chains along said first and second paths for gripping a tube with their said gripper members and for moving the tube, a slack adjuster for said first continuous gripper chain comprising:

a first main shaft pivotally coupled to said first pair of plate members, two first arm members having first ends fixedly coupled to said first main shaft and a first roller shaft coupled to second ends of said first two arm members, a first roller formed of plastic material supported to rotate around said first roller shaft, for engaging the inside said first continuous gripper chain, first clamp means coupled to said first main shaft and adjustably coupled to said first pair of plate members for allowing said first roller to be located at different positions relative to said first pair of plate members, a slack adjuster for said second continuous gripper chain comprising:

a second main shaft pivotally coupled to said second pair of plate members, two second arm members having first ends fixedly coupled to said second main shaft and a second roller shaft coupled to second ends of said two second arm members, a second roller formed of plastic material supported to rotate around said second roller shaft for engaging the inside of said second continuous gripper chain, and second clamp means coupled to said second main shaft and adjustably coupled to said second pair of plate members for allowing said second roller to be located at different positions relative to said second pair of plate members.

6. A coiled tubing handling apparatus, comprising:

a base, four spaced apart elongated frame members coupled to said base defining first and second opposite sides, a first pair of plate members coupled to said elongated frame members on said first and second opposite sides, a second pair of plate members coupled to said elongated frame members on said first and second opposite sides, a first drive sprocket coupled to said first pair of plate members, a first idler sprocket coupled to said first pair of plate members, a first continuous gripper chain, having gripper members, supported by said first drive sprocket and said first idler sprocket for movement along a first path, a second drive sprocket coupled to said second pair of plate members, a second idler sprocket coupled to said second pair of plate members, a second continuous gripper chain, having gripper members, supported by said second drive sprocket and said second idler sprocket for movement along a second path, said first and second gripper chains being supported for movement close to each other along said first and second paths for gripping a tube with their said gripper members, means for rotating said first and second drive sprockets together for moving said first and second gripper chains along said first and second paths for gripping a tube with their said gripper members and for moving the tube, said base comprises:

two lower spaced apart rails coupled to said base such that said two lower rails are located in two generally parallel outer planes, two slide members coupled to said two lower rails respectively for movement in said two outer planes, an upper base coupled to said two slide members, said first pairs of plate members being fixedly coupled to said upper base and said second pair of plate members being slidably coupled to said upper base for movement in two inner planes generally parallel to said two outer planes, first adjusting means coupled to said plate members of said first and second pairs of plate members for moving said second pair of plate members relative to said first pair of plate members, both of said pairs of plate members being movable together by moving said two slide members on said two lower rails, second adjusting means coupled to said first pair of plate members and to two of said elongated frame members closest to said first pair of plate members for moving said first pair of plate members and hence both pairs of plate members and said two slide members on said two lower rails relative to said two elongated frame members.

7. The apparatus of claim 6, comprising:

two spaced apart load members for coupling said upper base to said two slide members such that said two load members support said upper base to said two slide members, one of said load members comprising a transducer for sensing the load applied to said one load member.

8. The apparatus of claim 7, wherein said transducer produces an output equal to about twice the load sensed.

9. A coiled tubing handling apparatus, comprising:

a base, four spaced apart elongated frame members coupled to said base defining first and second opposite sides, a first pair of plate members coupled to said elongated frame members on said first and second opposite sides, a second pair of plate members coupled to said elongated frame members on said first and second opposite sides, a first drive sprocket coupled to said first pair of plate members, a first idler sprocket coupled to said first pair of plate members, a first continuous gripper chain, having gripper members, supported by said first drive sprocket and said first idler sprocket for movement along a first path, a second drive sprocket coupled to said second pair of plate members, a second idler sprocket coupled to said second pair of plate members, a second continuous gripper chain, having gripper members, supported by said second drive sprocket and said second idler sprocket for movement along a second path, said first and second gripper chains being supported for movement close to each other along said first and second paths for gripping a tube with their said gripper members, means for rotating said first and second drive sprockets together for moving said first and second gripper chains along said first and second paths for gripping a tube with their said gripper members and for moving the tube, a first pair of inner idler sprockets coupled to said first pair of plate members at fixed spaced apart positions surrounded by said first gripping chain, a first continuous linear bearing chain supported by said first pair of idler sprockets for rotation, a first elongated linear bearing race supported within said first linear bearing chain to cause said first linear bearing chain to engage said first gripper chain for causing said first gripper chain to move in a linear path along said first path, a second pair of inner idler sprockets coupled to said second pair of plate members at fixed spaced apart positions surrounded by said second gripper chain, a second continuous linear bearing chain supported by said second pair of idler sprockets for rotation, a second elongated linear bearing race supported within said second linear bearing chain to cause said second linear bearing chain to engage said second gripper chain for causing said second gripper chain to move in a linear path along said second path, a slack adjuster for said first continuous gripper chain comprising:

a first main shaft pivotally coupled to said first pair of plate members, two first arm members having first ends fixedly coupled to said first main shaft and a first roller shaft coupled to second ends of said first two arm members, a first roller formed of plastic material supported to rotate around said first roller shaft, for engaging the inside said first continuous gripper chain, and first clamp means coupled to said first main shaft and adjustably coupled to said first pair of plate members for allowing said first roller to be located at different positions relative to said first pair of plate members, a slack adjuster for said second continuous gripper chain comprising:

a second main shaft pivotally coupled to said second pair of plate members, two second arm members having first ends fixedly coupled to said second main shaft and a second roller shaft coupled to second ends of said two second arm members, a second roller formed of plastic material supported to rotate around said second roller shaft for engaging the inside of said second continuous gripper chain, and second clamp means coupled to said second main shaft and adjustably coupled to said second pair of plate members for allowing said second roller to be located at different positions relative to said second pair of plate members.

10. A coiled tubing handling apparatus, comprising:

a base, four spaced apart elongated frame members coupled to said base defining first and second opposite sides, a first pair of plate members coupled to said elongated frame members on said first and second opposite sides, a second pair of plate members coupled to said elongated frame members on said first and second opposite sides, a first drive sprocket coupled to said first pair of plate members, a first idler sprocket coupled to said first pair of plate members, a first continuous gripper chain, having gripper members, supported by said first drive sprocket and said first idler sprocket for movement along a first path, a second drive sprocket coupled to said second pair of plate members, a second idler sprocket coupled to said second pair of plate members, a second continuous gripper chain, having gripper members, supported by said second drive sprocket and said second idler sprocket for movement along a second path, said first and second gripper chains being supported for movement close to each other along said first and second paths for gripping a tube with their said gripper members, means for rotating said first and second drive sprockets together for moving said first and second gripper chains along said first and second paths for gripping a tube with their said gripper members and for moving the tube, a first pair of inner idler sprockets coupled to said first pair of plate members at fixed spaced apart positions surrounded by said first gripping chain, a first continuous linear bearing chain supported by said first pair of idler sprockets for rotation, a first elongated linear bearing race supported within said first linear bearing chain to cause said first linear bearing chain to engage said first gripper chain for causing said first gripper chain to move in a linear path along said first path, a second pair of inner idler sprockets coupled to said second pair of plate members at fixed spaced apart positions surrounded by said second gripper chain, a second continuous linear bearing chain supported by said second pair of idler sprockets for rotation, a second elongated linear bearing race supported within said second linear bearing chain to cause said second linear bearing chain to engage said second gripper chain for causing said second gripper chain to move in a linear path along said second path, said base comprises:

two lower spaced apart rails coupled to said base such that said two lower rails are located in two generally parallel outer planes, two slide members coupled to said two lower rails respectively for movement in said two outer planes, an upper base coupled to said two slide members, said first pairs of plate members being fixedly coupled to said upper base and said second pair of plate members being slidably coupled to said upper base for movement in two inner planes generally parallel to said two outer planes, first adjusting means coupled to said plate members of said first and second pairs of plate members for moving said second pair of plate members relative to said first pair of plate members, both of said pairs of plate members being movable together by moving said two slide members on said two lower rails, second adjusting means coupled to said first pair of plate members and to two of said elongated frame members closest to said first pair of plate members for moving said first pair of plate members and hence both pairs of plate members and said two slide members on said two lower rails relative to said two elongated frame members.

* * * * *